US012232579B2

(12) United States Patent
Shih et al.

(10) Patent No.: US 12,232,579 B2
(45) Date of Patent: Feb. 25, 2025

(54) POCKET ZIPPER CONNECTING SYSTEM

(71) Applicants: Alan Shih, Cathedral City, CA (US); Mahsa Zadeh, Rancho Mirage, CA (US)

(72) Inventors: Alan Shih, Cathedral City, CA (US); Mahsa Zadeh, Rancho Mirage, CA (US)

( * ) Notice: Subject to any disclaimer, the term of this patent is extended or adjusted under 35 U.S.C. 154(b) by 11 days.

(21) Appl. No.: 18/205,855

(22) Filed: Jun. 5, 2023

(65) Prior Publication Data

US 2024/0398071 A1 Dec. 5, 2024

(51) Int. Cl.
*A44B 19/26* (2006.01)
*A41D 27/20* (2006.01)

(52) U.S. Cl.
CPC ..... *A44B 19/262* (2013.01); *A41D 27/201* (2013.01)

(58) Field of Classification Search
CPC ..... A44B 19/262; A41D 27/201
See application file for complete search history.

(56) References Cited

U.S. PATENT DOCUMENTS 3,971,458 A * 7/1976 Koenig ..... A45C 13/42 24/387
4,156,295 A * 5/1979 LeRoy ..... A41D 27/20 2/252
4,876,724 A 10/1989 Suzuki
7,232,018 B1 * 6/2007 Salander ..... A45C 5/14 280/37
11,330,854 B2 * 5/2022 Abukashef ..... A41D 1/04
11,632,992 B2 4/2023 Boyd et al.
2008/0245096 A1 * 10/2008 Hanson ..... A45C 11/20 220/592.2
2013/0254969 A1 * 10/2013 Getzen ..... A41D 1/02 2/108
2016/0029717 A1 * 2/2016 DiMarco ..... A41D 27/205 2/69
2016/0262476 A1 * 9/2016 Crockett ..... G21F 1/125
2017/0281291 A1 * 10/2017 Garratt ..... A61B 50/31
2018/0255887 A1 * 9/2018 Poss ..... A45C 7/0077
2019/0000206 A1 * 1/2019 Domizi ..... A42B 1/225
2019/0090596 A1 * 3/2019 Huyke-Phillips .... A44B 19/301
2019/0246749 A1 * 8/2019 Mak ..... A44B 19/20
2019/0274374 A1 * 9/2019 Marconi ..... A41D 1/08
2020/0029637 A1 1/2020 Boyd
2020/0305565 A1 * 10/2020 Maman ..... A45C 7/009
2023/0101699 A1 3/2023 Bolker
2024/0090637 A1 * 3/2024 Atwood ..... A45C 3/06

* cited by examiner

*Primary Examiner* — Robert H Muromoto, Jr.
(74) *Attorney, Agent, or Firm* — Kirk A. Buhler; Buhler & associates Patenting

(57) ABSTRACT

A garment that is configured to protect against theft or otherwise unauthorized access of pocket items. The garment contains a pocket zipper connecting assembly system that is accessible from one or more garment surfaces, having pockets that feature zippers, each with an engagement device. The engagement device connects the zipper to another aspect of the garment, including a securing structure, or to the engagement device on another zipper. The latter case may comprise two pockets featuring zipper closures with the zippers in closed position when zipped towards each other, and each zipper engagement device featuring a complementing interface that connects the zippers together. The mutually conjoined zippers are secure against unintended opening.

16 Claims, 4 Drawing Sheets

POCKET ZIPPER CONNECTING SYSTEM

CROSS-REFERENCE TO RELATED APPLICATIONS

Not Applicable.

PRIOR ART

Pockets in garments can contain common theft items that may include, but are not limited to, wallets, cellular phones, keys, credit cards, event entrance passes, paper monies, and forms of identification. Traditional means of securing these valuable items in pockets can be cumbersome, inconvenient, expensive, or easily defeated. These can include traditional pockets, single strap bags, such as purses, other handbags, double strap bags and backpacks.

Traditional seamed front pants pockets, such as those found on work trousers, are open and easily accessible. This is true for many pocket styles, which are usually designed for comfort, ease-of-use, and fashion, rather than security of belongings. Back pockets in particular are vulnerable to undetected theft, as the victim's attention is often directed in the opposite direction of the pocket. Even back pockets that are zippered, buttoned, or otherwise closed can be swiftly undone by a skilled perpetrator with quick hands.

Various garments have been proposed that feature securing systems for pockets. The Boyd et al., U.S. Pat. No. 11,632,992 issued on Apr. 25, 2023, titled "Secure Pocket Structure", features a garment design that includes inner and outer pocket layers, as well as a funnel-shaped structure between the inner and outer layers, to securely store items within the pocket structure. This patent does not feature a system to ensure complete closure of the pocket structures. By way of example, in the case that the garment wearer capsizes or is otherwise positioned in an upside-down fashion, the pocket contents may spill out.

The Cynthia Bolker, U.S. Patent Application Publication No. 2023/0101699 published on Mar. 30, 2023, titled "Garment with Cell Phone Pockets", discloses a garment that can securely store a cell phone and other valuables. This patent application similarly does not include a means of closing the pocket or maintaining a pocket closure secure.

What is needed is a pocket with a securing system that reduces or eliminates theft of items within a pocket. The pocket zipper connecting system disclosed in this document provides the solution.

BACKGROUND OF THE INVENTION

The present disclosure relates generally to the field of clothing and apparel. More specifically, the disclosure relates to a garment that includes pocket structures that can reduce the likelihood of unauthorized or unintended opening of the pockets and prevents theft or other means of loss of contents.

SUMMARY OF THE INVENTION

It is an object of the pocket zipper connecting system invention to provide a pocket system for articles of apparel which overcomes the disadvantages of prior devices and prevents theft or other unauthorized access to a wearer's items that are placed in the pocket(s).

It is an object feature of the pocket zipper connecting system to provide a pocket system that is incorporated into upper and/or lower body garments including shirts, jackets, coats, sweaters, pants, shorts, skirts, or other similar garments.

It is another object of the pocket zipper connecting system to provide a pocket system that is accessible from one or more garment surfaces, having at least one pocket featuring a zipper closure that comprises an engagement device for the zipper pull.

It is another object of the pocket zipper connecting system to provide a pocket system having at least one securing structure to which the pocket zipper engagement device can attach and secure.

It is another object of the pocket zipper connecting system to provide a pocket system comprising a plurality of zipper engagement devices having complementing interfaces to connect at least one zipper to at least one other aspect of a garment, including a securing structure.

It is another object of the pocket zipper connecting system to provide a pocket system having at least two pockets featuring zipper closures with the zippers in closed position when zipped towards each other.

It is another object of the pocket zipper connecting system to provide a pocket system comprising a plurality of zippers having engagement devices on the zipper pulls that can connect a plurality of zipper pulls together. The conjoined zipper pulls secure against unintended opening by way of the engagement devices.

It is another object of the pocket zipper connecting system that a preferred embodiment of the invention comprises a zipper closure for at least one pocket on each side of midline of a garment.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
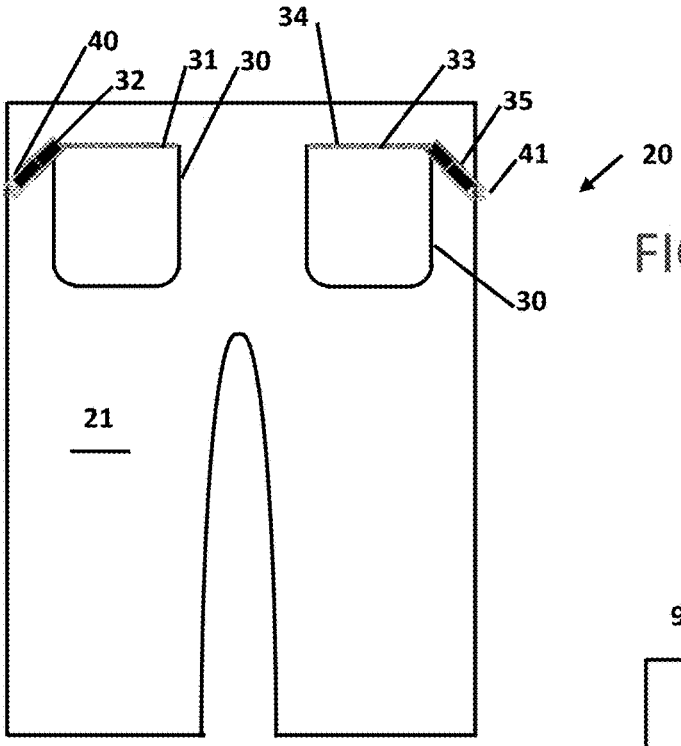
FIG. 1 shows a front elevation view of an embodiment of pants with pockets having zippers with the zippers in open position, and each zipper including a complementing engagement device that connects corresponding zippers together.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

| Item Numbers and Description | |
|---|---|
| 20 pocket zipper connecting system | 21 garment |
| 22 garment | 23 engagement receiver |
| 30 pocket | 31 zipper closure |
| 32 zipper pull | 33 another closure zipper |
| 34 engaging teeth | 35 zipper pull |
| 40 engagement device | 41 complementing mating device |
| 50 secured links | 51 securing structure |
| 90 towards | 91 swing or rotate |

Referring to FIGS. 1-8, in accordance with certain preferred embodiments of the present garment that features a pocket zipper connecting system is shown. Although the present garment shown is a pair of pants, it is understood that this representation is used to include other garments, including for upper body use and lower body use, such as shorts, shirts, jackets, or other wearables.

Figure 2:
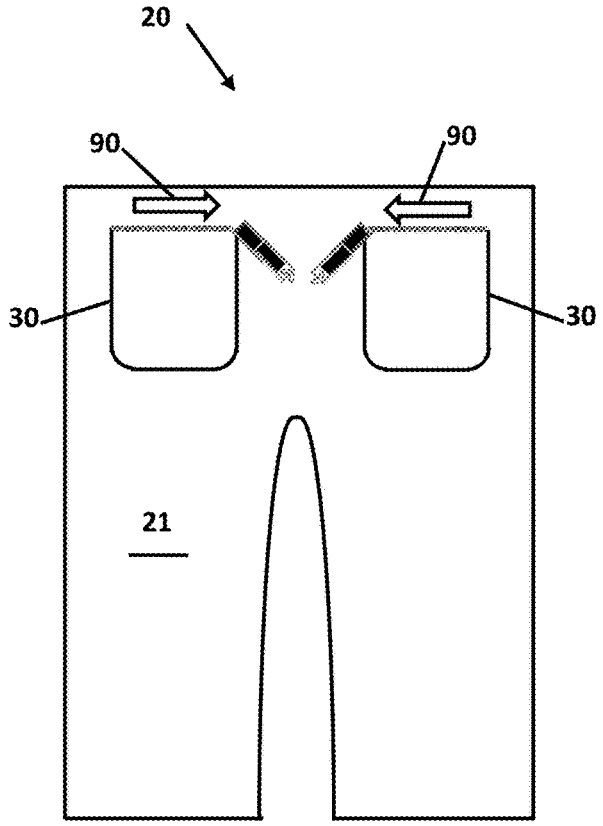
FIG. 2 shows the garment of FIG. 1 with the zippers for each pocket in a closed position near the midline of the garment.

Referring to FIG. 1, a garment 21 with a pocket zipper connecting system 20. The garment 21 preferably includes a plurality of pockets 30 on each side of the garment midline, each pocket 30 is bound on three sides with a sewn structure and having a zipper closure 31 with engaging teeth 34 on the fourth side with the zippers in closed position when zipped towards 90 the midline (as shown in FIG. 2), and each zipper 31 featuring an engagement device 40 on the zipper pull 32 that connects each zipper 31 to the complementing mating device 41 of another closure zipper 33 on a zipper pull 35.

While the figures show zipper(s) it is contemplated that the zippers can be a button closure, a snap closure, a magnet closure, or a hook and loop closure that is configured for temporal closing and opening of a fourth side of one or more pockets. The tab would extend horizontally from the pocket opening similar to the zipper pull. The free end of the tab would include the engagement device 40.

In a preferred embodiment, at least one zipper engagement device 40 comprises a rigid material made of metal or hard plastic, or any material that offers firm shape for a traditional button or snap button connection. Other embodiments may include a flexible material comprising rope, thread, soft plastic, drawstring, rubber, or any material that offers a pliable shape and other attributes necessary for a fastening interface such as a loop or tie.

It is envisioned that the zipper 31, 33 may be replaced with alternate means of closure and fastening, including but not limited to, traditional garment buttons, snap buttons, magnets, hook closures, hook and loop or other devices, or combination of devices, that may connect one aspect of a garment pocket to another aspect of the same pocket.

FIG. 2 shows the garment 21 of FIG. 1 with the zippers 31/33 for each pocket 30 in a preferred embodiment, with the zippers pulls oriented in a closed position when zipped towards 90 the midline of the garment 21. In a preferred embodiment, a plurality of zippers 31/33 is positioned in proximity on the same garment 21, with orientation of the zipper closures 31/33 directed toward 90 each other.

Figure 3:
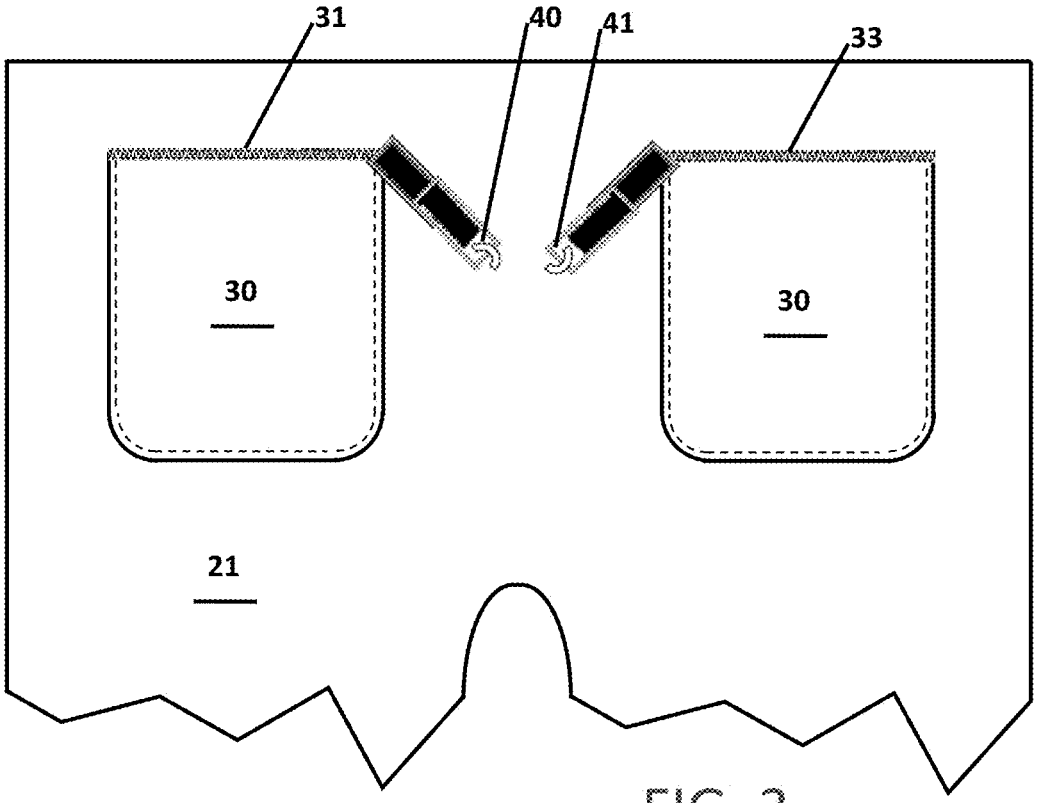
FIG. 3 shows a perspective view of an embodiment of each zipper having a complementing engagement device.

FIG. 3 shows a close-up perspective view of the garment 21 of FIG. 2. Each pocket 30 is shown bound on three sides with a sewn structure or the like. At least one zipper 31 comprises an engagement device 40 as shown in FIG. 1. In various embodiments, the engagement device 40 may comprise at least one complementing mating device 41 that connects to make secure links bringing the plurality of zippers 31/33 together.

Figure 4:
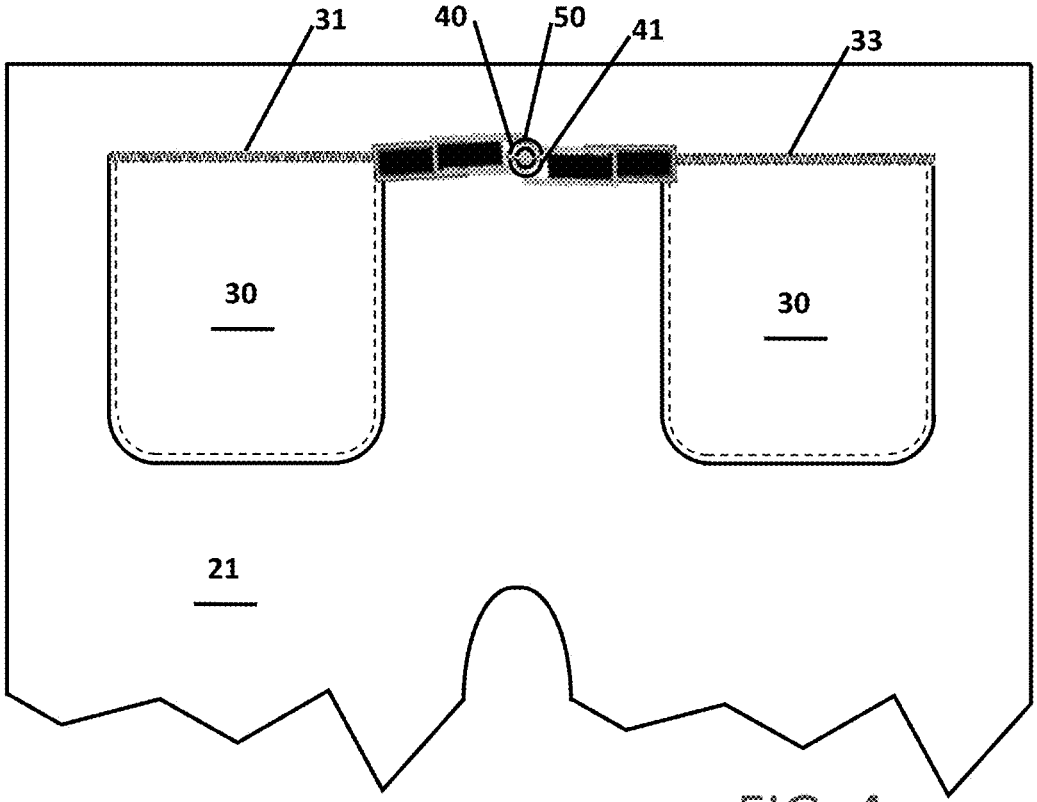
FIG. 4 shows the garment of FIG. 1 with the zippers for each pocket in closed position, with the complementing engagement devices of FIG. 3 connecting the corresponding zippers together.

FIG. 4 shows a close-up perspective view of the garment of FIG. 2, with the complementing engagement devices 41 of FIG. 3 connecting the zippers 31/33 together to provide a secured link of the engagement device 40 and the complementing mating device. Various embodiments may comprise a traditional garment button to button interface, conjoined magnets, a hook and loop closure system, or other assembly, or combination of assemblies, to connect at least one aspect of a pocket 30 structure to at least one structure present on the same garment 21. A preferred embodiment may comprise the engagement device 40/41 of a zipper 31 connected to the engagement device 40 of another zipper 33, but may also comprise the engagement device connected to a securing structure present on another aspect of the garment 21 as shown and described in other figures herein.

Figure 5:
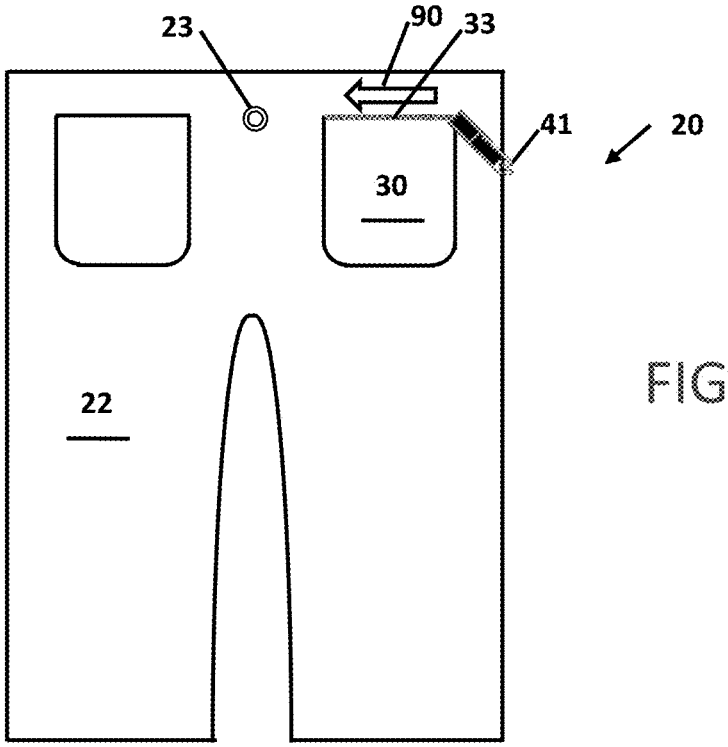
FIG. 5 shows a front elevation view of an embodiment of pants with a pocket having a zipper with the zipper having an engagement device.

FIG. 5 shows a front elevation view of an embodiment of a garment 22 with a pocket 30 having a zipper 33 as a pocket zipper connecting system 20. The zipper 33 comprises an engagement device 41 similar to that shown in FIG. 1. An engagement receiver 23 is included with this embodiment. While engagement receiver 23 is shown between the pockets 30, it could also be located at a side of the garment 22 where a user could access the engagement features from the side of the garment 22 as opposed to the front or rear of the garment 22.

Figure 6:
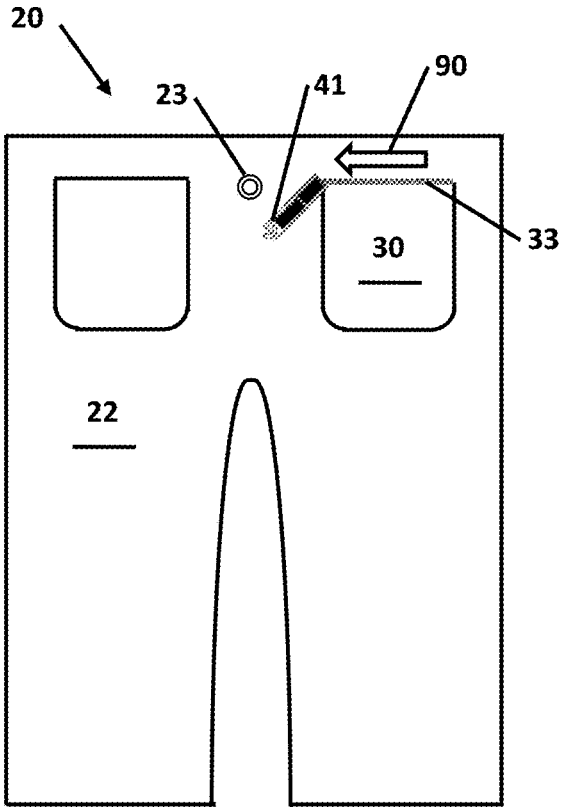
FIG. 6 shows the garment of FIG. 5 with the zipper in a closed position.

FIG. 6 shows garment 22 with the pocket zipper connecting system 20 of FIG. 5 with the zipper in a preferred embodiment, with the zipper oriented in a closed position when zipped towards 90 the engagement receiver 23. In a preferred embodiment, the zipper 33 is positioned in proximity to the engagement receiver 23 on the same garment 22, with orientation of closure directed towards 90 the engagement receiver 23. As is shown in this figure, only one pocket has an engagement feature.

Figure 7:
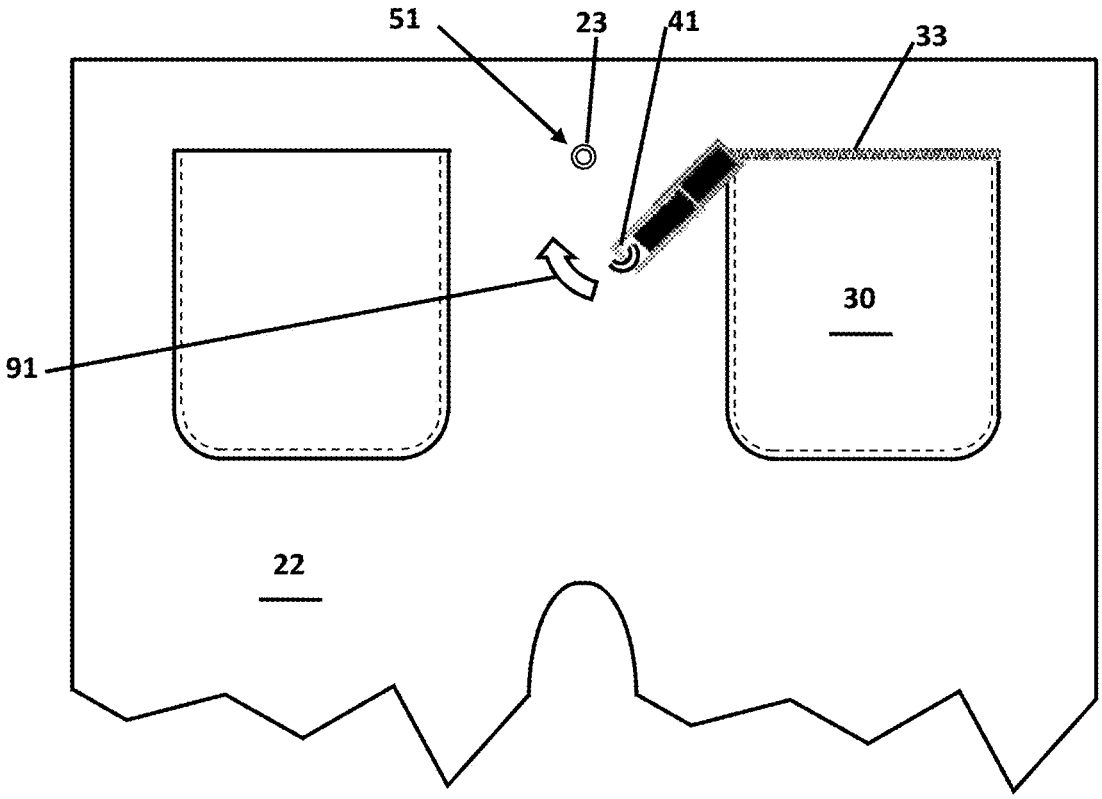
FIG. 7 shows a perspective view of the garment of FIG. 5 having a securing structure in close proximity to the zipper.

FIG. 7 shows a close-up perspective view of the garment 22 of FIG. 5 comprising a securing structure 41 in proximity to the zipper 33 near the engagement receiver 23. In a preferred embodiment, engagement receiver 23 comprises a round stud made of metal or hard plastic, or any material that offers firm shape to allow for a snap button connection. Other embodiments may comprise a mating interface for a traditional garment button, magnet, hook and loop closure, or other mating device, or combination of mating devices, to connect at least one zipper engagement device 41 to at least one securing structure 51 engagement receiver 23 present on the same garment 22.

A preferred embodiment of the securing structure engagement receiver 23 is fixed in place on at least one surface of garment 22. It is envisioned that the securing structure 41 may be freely swung or rotated 91 from the zipper pull along one or more surfaces of a garment 22.

Figure 8:
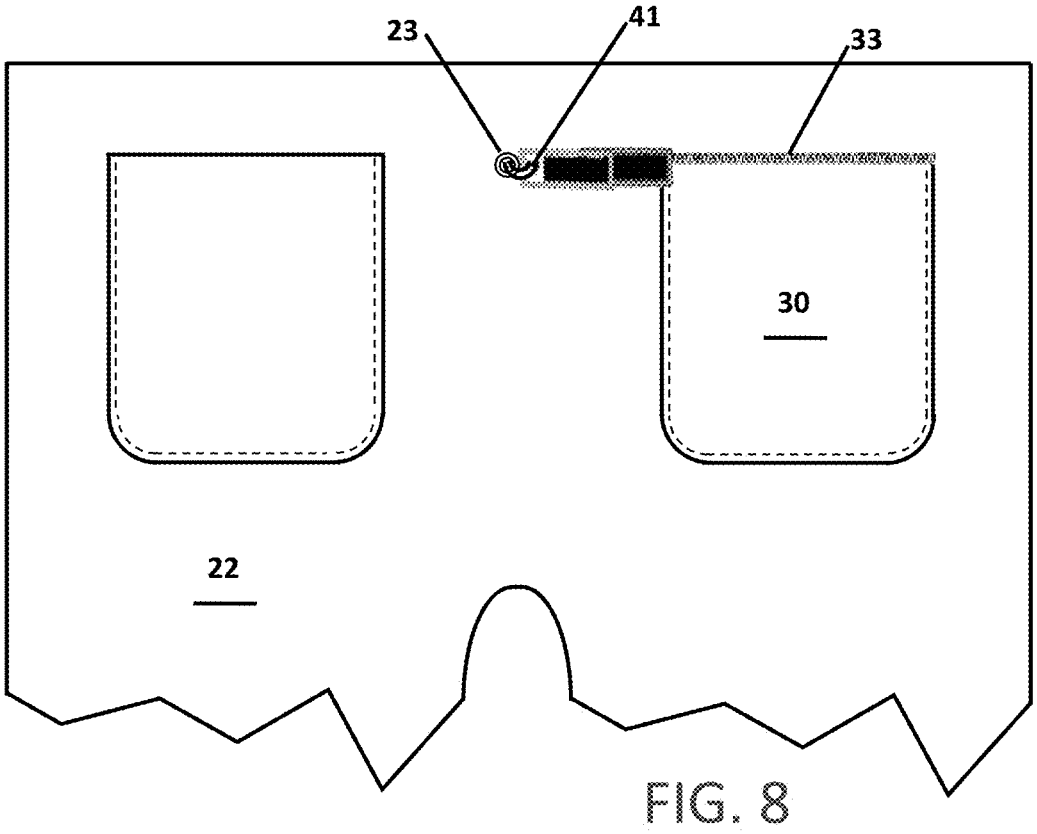
FIG. 8 shows a perspective view of the zipper engagement device of FIG. 5 connected to the securing structure of FIG. 7.

FIG. 8 shows a close-up perspective view of the zipper engagement device 41 of FIG. 5 connected to the engagement receiver 23 of FIG. 7 on the pocket. While engagement receiver 23 is shown between the pockets 30, it could also be located at a side of the garment 22 where a user could access the engagement features from the side of the garment 22 as opposed to the front or rear of the garment 22.

It is further contemplated that when the garment is made with securing features on both pockets and the engagement receiver 23, that the securing features of each pocket can be separately or collectively connected into the engagement receiver 23.

Thus, specific embodiments of a pocket zipper connecting system have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A pocket zipper connecting system comprising:

a garment having a first pocket;

said first pocket having a lower area that is bound on three sides with a sewn structure;

said first pocket having a fourth side having a first zipper that is configured for temporal closing and opening of a fourth side of said first pocket;

said first zipper having a first slider for engaging teeth or chain of said first zipper;

a first zipper pull that is connected to said first slider at a first end of said first zipper pull;

a second end of said first zipper pull having at least one engagement feature that is configured to engage onto a securing structure on said garment, and at least a second pocket having a second zipper pull, wherein when said first zipper pull and said second zipper pull are pulled towards each other closes said first pocket and said at least a second pocket.

2. The pocket zipper connecting system according to claim 1, wherein said first zipper comprises a rigid material made of metal, or a flexible material made of fabric or pliable material.

3. The pocket zipper connecting system according to claim 1, wherein said at least one engagement feature comprises complementing mating interface.

4. The pocket zipper connecting system according to claim 1, wherein said at least one engaging feature is a button, a buttonhole, a magnet, or a hook and loop closure system.

5. The pocket zipper connecting system according claim 1, wherein said first zipper pull and said second zipper pull are positioned in proximity on said garment, with orientation of said first zipper pull and said second zipper pull in-line with each other.

6. The pocket zipper connecting system according to claim 1, wherein said first pocket and said at least a second pocket are on opposing midline of said garment.

7. The pocket zipper connecting system according to claim 1, wherein said at least one engaging feature is configured to connect to a second engaging feature on said second zipper pull.

8. The pocket zipper connecting system according to claim 1, wherein said at least one engagement receiver is a rigid material made from metal or a flexible material made from plastic or fabric.

9. The pocket zipper connecting system according to claim 1, wherein said securing structure further includes at least one engagement receiver located in proximity to said first pocket.

10. A pocket securing system comprising:

a garment having a first pocket;

said first pocket having a lower area that is bound on three sides with a sewn structure;

said first pocket having a fourth side having a button closure, a snap closure, a magnet closure, or a hook and loop closure that is configured for temporal closing and opening of a fourth side of said first pocket;

a first tab extending horizontally from said fourth side of said first pocket at a first side of said first tab;

a second end of said first tab having at least one engagement feature that is configured to engage onto a securing structure on said garment, and at least a second pocket having a second tab, wherein when said first tab and said second tab are pulled towards each other closes said first pocket and said at least a second pocket.

11. The pocket securing system according to claim 10, wherein said at least one engagement feature comprises complementing mating interface.

12. The pocket securing system according to claim 10, wherein said at least one engagement feature is a button, a buttonhole, a magnet, or a hook and loop closure system.

13. The pocket securing system according to claim 10, wherein said first tab and said second tab are positioned in proximity on said garment, with orientation of said first tab and said second tab in-line with each other.

14. The pocket securing system according to claim 10, wherein said first pocket and said at least a second pocket are on opposing midline of said garment.

15. The pocket zipper connecting system according to claim 1, wherein said at least one engaging feature is configured to connect to a second engaging feature on said second tab.

16. The pocket securing system according to claim 1, wherein said securing structure is located in proximity to said first pocket.

* * * * *